United States Patent [19]

Fujii et al.

[11] Patent Number: 4,910,945

[45] Date of Patent: Mar. 27, 1990

[54] BAND FEEDING AND TIGHTENING APPARATUS FOR STRAPPING MACHINE

[75] Inventors: Kenji Fujii, Yamato; Tsutomu Tagomori, Kanagawa, both of Japan

[73] Assignee: Strapack Corporation, Tokyo, Japan

[21] Appl. No.: 179,568

[22] Filed: Apr. 8, 1988

[30] Foreign Application Priority Data

Apr. 17, 1987 [JP] Japan ..... 62-93109

[51] Int. Cl.[4] ..... B65B 13/22; B65B 13/18; B65B 13/06

[52] U.S. Cl. ..... 53/589; 100/29; 100/32

[58] Field of Search ..... 53/582, 589, 399; 100/29, 32; 226/96, 110, 143, 176, 186, 187, 193

[56] References Cited

U.S. PATENT DOCUMENTS

| | | | |
|---|---|---|---|
| 2,326,670 | 8/1943 | Patterson, Jr. | 226/186 X |
| 2,786,672 | 3/1957 | Humphner | 226/186 |
| 3,023,963 | 3/1962 | Crosby et al. | 100/32 |
| 3,077,293 | 2/1963 | Watkins | 226/186 |
| 3,132,785 | 5/1964 | Kunz | 226/186 X |
| 3,752,058 | 8/1973 | Lems | 100/32 |
| 4,383,881 | 5/1983 | Sakaki . | |
| 4,444,097 | 4/1984 | Wehr et al. | 100/32 X |
| 4,683,017 | 7/1987 | Figiel et al. | 53/589 X |

FOREIGN PATENT DOCUMENTS

| | | |
|---|---|---|
| 513271 | 8/1976 | Japan . |
| 5211918 | 4/1977 | Japan . |
| 55/34051 | 9/1980 | Japan . |
| 1123052 | 9/1980 | Japan . |
| 61-164918 | 7/1986 | Japan . |

*Primary Examiner*—Horace M. Culver

*Attorney, Agent, or Firm*—Burns, Doane, Swecker & Mathis

[57] ABSTRACT

A strapping apparatus advances a band around an object to be strapped and then retracts and tightens the band against the object. Retraction of the band is performed by a driven roller. A touch roller is displaceable toward the driven roller to press the band thereagainst. The outer periphery of the driven roller comprises a flexible high friction material, and a circumferentially extending low friction material embedded in the high friction material and normally projecting radially outwardly therebeyond. When the band travels against the low-friction material it encounters little resistance. When the touch roller pushes the band against the driven roller, the low-friction material is pushed radially inwardly, enabling the band to contact and be driven by the high-friction material.

8 Claims, 3 Drawing Sheets

BAND FEEDING AND TIGHTENING APPARATUS FOR STRAPPING MACHINE

BACKGROUND OF THE INVENTION

1. Field of the Invention

The present invention relates to a band-feeding and tightening apparatus composed of at least a pair of rollers which are brought into compressive contact with each other through the intermediary of a band for retracting the strapping band against an article to be strapped after the band has been fed around the article to be strapped. The present invention relates in particular to a roller structure for tightening the band against the article to be strapped.

2. Description of the Prior Art

Band-feeding and tightening apparatuses composed of two or more pairs of rollers are conventional such as disclosed in U.S. Pat. No. 4,383,881 and Japanese Pat. No. 1,123,052.

As an example, means disclosed in Japanese Pat. No. 1,123,052 is illustrated in FIG. 4 and comprises a feed shaft 32 to which a feed roller 31 is fixed and a return shaft 34 to which a return roller 33 is fixed. Those shafts are caused to rotate at high speed in opposite directions relative to each other through the intermediary of a differential speed reducer. The band is fed into the strapping machine by bringing touch rollers 35*a* and 35*b* into compressively contact with the outer periphery of the feed roller 31; the primary tightening of the band is performed by bringing another touch roller 36 into compressively contact with the outer periphery of the return roller 33; and powerful secondary tightening is performed by means of a low-speed high-torque of the differential speed reducer by virtue of a crank connected to the return shaft 34 of the return roller 33, which crank starts to slide when the strength of tightening reaches a predetermined value thereby rapidly reducing the rotation of the return shaft 34.

The touch roller 36 is provided adjacent the lower surface of the return roller 33 to wind the band around the outer periphery of the return roller 33 whereby the contact area of the band with the return roller 33 is increased to prevent the band from slipping against the return roller 33 in the case of band tightening for performing firm tightening. When the band is fed by a high-speed feed roller 31 and when the band is fed by a return roller 33, the return roller 33 is also caused to reverse rotation at a high speed, such that the band is inevitably brought into contact with the return roller 33 which is reversely rotating which the band which is fed forwardly at a high speed. For this reason, the return roller 33 would wear out after a short period of time and could fuse to the band because of heat of friction between the return roller 33 and the band. There is a known disadvantage in that the band is jammed in an area between the outer periphery of the return roller 33 and the guide body 37 thereby making the band feeding impossible. It may occur that the touch roller 35*a* is brought into weak, compressive contact with the feed roller 31 and the touch roller 35*b* is brought into strong compressive with the feed roller 31 thereby preventing the contact of the band with return roller 33.

The above-described disadvantages may be regarded as being common to means provided with one or more roller pairs for retracting and tightening the band in addition to paired feed rollers for feeding the band. It has been learned that the disadvantages are mainly attributed to the outer periphery of the return roller 33 using a material or a shape to achieve high friction resistance for ensuring high torque, such as a metal on which a knurl is notched. Also, the disadvantages result from the fact that the feed rollers and the return roller caused to continuously rotate forward and reversely, respectively, for enhancing strapping efficiency. It is obvious that the band which is brought into contact with these rollers is subjected to high wear. Other problems result if the band slips off the rollers, and yet the presence of the guide body 37 to contain such a slipped band can itself result in a jamming of the band during normal band travel.

SUMMARY OF THE INVENTION

It is an object of the present invention to solve the above-described drawbacks, to smoothly perform band feeding at a very high speed without interrupting the feeding and tightening operations of the strapping band, and to accurately perform the tightening operation. In an apparatus for feeding and tightening the band in a strapping machine composed of feed rollers for feeding a band, and retracting rollers for tightening the band, the rollers for tightening the band are disposed behind the feed rollers, the outer periphery of preferably the band-tightening driven roller is formed of an elastic body of a high friction resistance, and a circumferentially extending member which is harder and has lower friction resistance than the elastic body. The lower-friction member normally projects beyond the high-friction material to enable the band to slide smoothly on the low friction member. The low friction member can be displaced inwardly when the band is pushed against the driver roller, whereby the band contacts and is driven by the high-friction material.

BRIEF DESCRIPTION OF THE DRAWINGS

The objects and advantages of the invention will become apparent from the following detailed description of preferred embodiments thereof in connection with the accompanying drawings, in which like numerals designate like elements, and in which.

DETAILED DESCRIPTION OF PREFERRED EMBODIMENTS OF THE INVENTION

Figure 1:
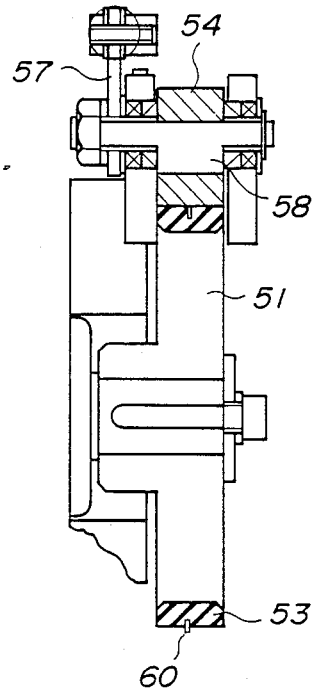
FIG. 1A which illustrates one embodiment of the present invention, is a sectional view taken along line 1A—1A in FIG. 2.
FIG. 1B is a fragmentary sectional view of an alternate embodiment.
Figure 1:
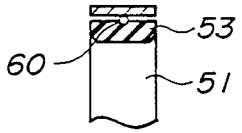
Figure 2:
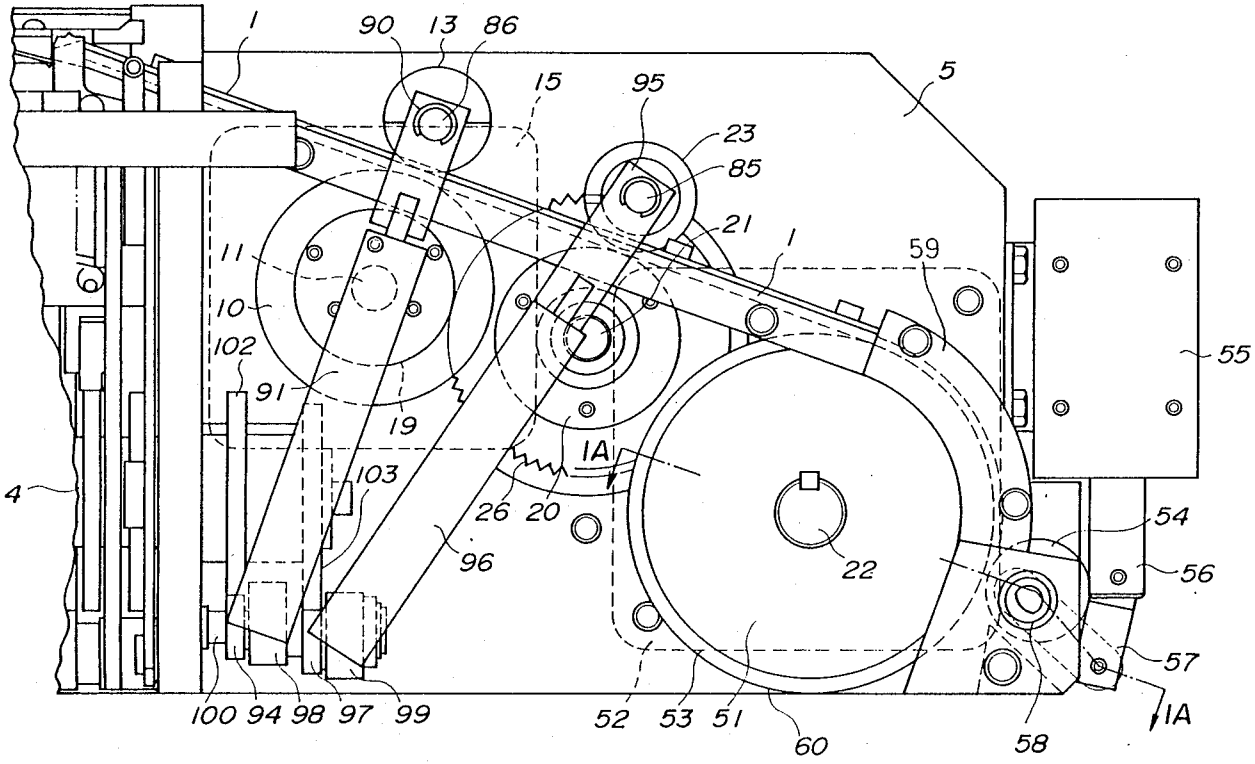
FIG. 2 is a side elevational view of a band feeding and retracting mechanism.

The mechanism is provided with a feed roller 10 which faces the band chute 1 and feeds a band toward the guide arch (not shown) at a regular interval, and with a reverse roller 20 for returning and winding the band around an article to be strapped. A reduction gear type motor 15 is directly connected to the drive shaft 11 of the feed roller 10, and a gear 19 attached to the drive shaft 11 is meshed with a larger diameter gear 26 connected to the shaft 21 of the reverse roller 20. Accordingly, the feed roller 10 and the reverse roller 20 always rotate in directions opposite to each other.

Figure 3:
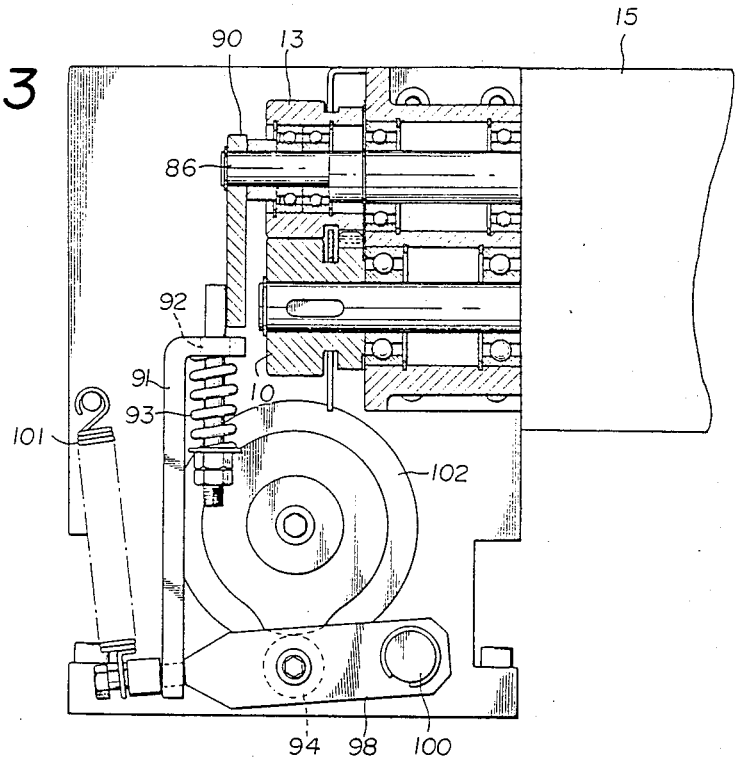
FIG. 3 is a sectional view through the feed rollers.
Figure 4:
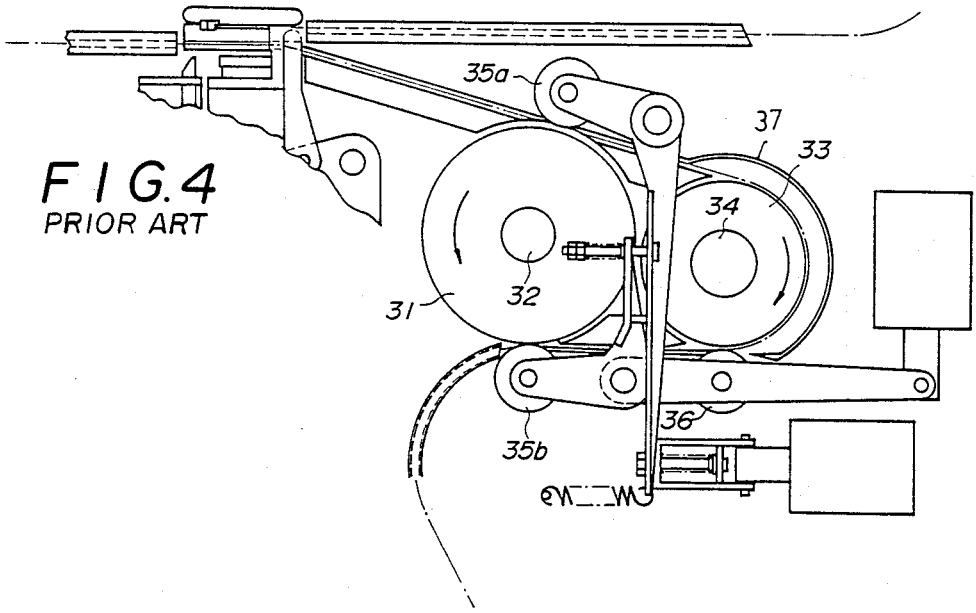
FIG. 4 PRIOR ART
FIG. 4 is a schematic diagram showing prior art.

Numerals 13 and 23 denote feed and reverse touch rollers, respectively, which have a similar structure. The structure related to both touch rollers is described with reference to FIG. 3 showing the actuating mechanism of the feed touch roller 13. Both of the touch rollers are supported by eccentric shafts 86 and 85, to the ends of which the upper ends of acting levers 90 and 95 are pivotally attached. The lower ends of these levers 90, 95 are loosely inserted into holes 92 bored through the bent pieces of L-shaped interlocking levers 91 and 96 and are connected to the levers 91, 96 through the intermediary of springs 93. The lower ends of the levers 91, 96 are attached to the tips of arm levers 98 and 99, respectively, having rolls 94 and 97. One end of each of the arm levers 98 and 99 is pivotally supported by a shaft 100 mounted on the base plate, and a spring 101 is locked at another end thereof to bias the respective touch roller 13, 23 away from the band.

Cams 102 and 103 are mounted on a shaft which is the extension of a cam shaft 4 which actuates a conventional band fusion mechanism composed of a known band gripper, a heater and a center press, etc., and are brought into contact with the rollers 94 and 97 of the arm levers 98 and 99, respectively, to perform a band tightening action via the interlocking levers 91 and 96, and the acting levers 90 and 95.

In the embodiment illustrated herein, the feed touch roller 13 and the reverse touch roller 23 which are the locker rollers are used as follower rollers to push the band against the feed roller 10 and the reverse roller 20. The feed roller 10 and the feed touch roller 13 may be meshed with the reverse roller 20 and the reverse touch roller 23, respectively, by means of gears with the same diameters at high and low positions to effect forward and reverse rotations relative to each other.

A portion of the circumference of a tension roller 51 corresponding to the above-described return roller is disposed at the rear end of a chute 1 and the drive shaft 22 of the tension roller 51 is directly connected to a tightening motor 52 composed of a brake-equipped geared motor attached to the reverse side of a base plate 5. As shown in FIG. 1, the tension roller 51 is a large-diameter metallic roller and an elastic body of a large friction resistance, such as urethane, is adhered to the outer periphery of the metallic roller. The center in the width direction of the outer peripheral surface of the elastic body 53 is provided with a notch, in which is embedded an annular member 60 in the form of a thrust washer formed of a metal material which is harder and has a smaller friction resistance than the elastic body, such as stainless steel. The annular member 60 is projected from the outer periphery of the elastic body 53 by a slight distance such as 0.2 to 0.3 mm. Although the annular member 60 is preferably circumferentially endless, it may alternatively be formed intermittently with slight intervals interposed therebetween. The annular member 60 may, as illustrated in FIG. 1(B), alternatively be in the form of a wire with a circular cross-section.

A tension touch roller 54 is rotatably mounted on an eccentric shaft 58 which is carried at one end of a crank 57 the other end of which is connected to the rod 56 of a solenoid 55. The outer periphery of the tension touch roller 54 is so constructed as to be capable of compressive contact with and separation from the outer periphery of the tension roller 51 by means of expansion and contraction of the rod 56.

A guide chute 59 covers a portion of the outer periphery of the tension roller 51 and forms therewith a gap for allowing the band to pass. One end of the chute 59 faces the rear end of the band chute 1 and the other end thereof faces a portion of the outer periphery of the tension touch roller 54.

Initially, the band is wound around an article to be strapped by passing through a band guiding arch (not shown) on the main body of a strapping machine (or manually) until the front end of the band has reached a band fusion mechanism. Then the cam 102 is positioned so that it does not push down the roll 94, so a gap of a thickness exceeding that band is formed between the feed roller 10 and the feed touch roller 13, such that there is no effect on the band in the band chute 1. The relation between the reverse roller 20 and the reverse touch roller 23 is also the same as the above. Then, the cam shaft 4 is rotated by a starting switch and the band front end is grasped by a mechanism in the band fusion mechanism. Because the cam begins rotating, the acting lever 95 is pushed down through the intermediary of the roll 97, the arm lever 99, and the interlocking lever 96. The reverse touch roller 23 pushes the band into compressive contact with the reverse roller 20. Accordingly, the band is retracted at high speed (the primary tightening).

The tension roller 51 will have started rotation by means of the tightening motor 52 simultaneously with the primary tightening. The band is retracted during primary tightening while smoothly sliding around the annular member 60.

When the band is removed from the arch and wound around the article to be strapped, a signal for detecting the fact (by means of a timer or other conventional means) excites the solenoid 55 whereby the tension touch roller 54 on the eccentric shaft 58 pushes the band into compressive contact with the tension roller 51 through the action of the crank 57. The annular member 60 on the elastic body 53 is pressed into the elastic body 53 by the band at a position at which the tension touch roller 54 is brought into contact with the band whereby the band is tightened by the peripheral surface of the elastic body.

When the band is firmly wound around the article to be strapped, means for detecting completion of band tightening (not shown) detects the fact to produce a tightening completion signal, which causes the tightening motor 52 to stop. The cam shaft 4 rotates again to cause the rollers 10, 13 to grasp the band feeding end and also to relieve the excitement of the solenoid 55. Also, the rotation of the cam shaft 4 swings the arm lever 99 whereby the compressive contact of the reverse touch roller 23 with the reverse roller 20 is relieved. The cam shaft 4 continues rotation to actuate a band fusion mechanism to effect a fusion of the band-joining portion and a cutting of the band-feeding end. When the rotation of the cam shaft 4 renders the feed roller 10 and the feed touch roller 13 in a state as given in FIG. 3 for compressing the band between both rollers, a predetermined amount of the band is fed to the guide arch.

The band in a predetermined length is fed by the timer and re-rotation of the cam 102 completes the band feeding. Subsequent to it, a limit cam (not shown) which interlocks with the cam shaft 4 is actuated to turn a clutch which interlocks the rotation of the motor OFF with the cam shaft 4 through the intermediary of a speed reducer 9 whereby rotation of the cam shaft 4 is caused to stop thereby returning the respective mechanism to the original position.

While the band is being re-fed to the arch, the band travels smoothly because the band travels along the projected annular member 60 which is of a small friction resistance so that the band is subjected to minimal friction and resistance by the tension roller 51.

The cam shaft 4 rotates again because of a timer or another control means to rotate the eccentric shaft 86 through the action of the acting lever 90 whereby the compressive contact of the feed touch roller 13 with the feed roller 10 is ended, thereby finishing one process of strapping.

What is claimed is:

1. In a strapping apparatus for feeding and tightening a band around an object to be strapped, including feed roller means for advancing the band around the object and retracting roller means for retracting and tightening the band against the object, the improvement wherein one of said feed and retracting roller means comprises a driven roller and an opposing touch roller, said touch roller being selectively displaceable toward said driven roller for pressing the band thereagainst, an outer periphery of said driven roller comprising a flexible high-friction material and a generally circumferentially extending low-friction member, said low-friction member normally projecting radially outwardly beyond said high-friction material to enable the band to travel freely on said low-friction material, said low-friction member being compressible radially inwardly when said touch roller presses the band against said outer periphery, to enable the band to contact said high-friction material and be driven thereby.

2. In a strapping apparatus for feeding and tightening a band around an object to be strapped, including feed roller means for advancing the band around the object and retracting roller means for retracting and tightening the band against the object, the improvement wherein said retracting roller means comprise a driven roller and an opposing touch roller, said touch roller being selectively displaceable toward said driven roller for pressing the band thereagainst, an outer periphery of said driven roller comprising a flexible high-friction material and a generally circumferentially extending low-friction member disposed in said high-friction material, said low-friction member normally projecting radially outwardly beyond said high-friction material to enable the band to travel freely on said low-friction member, said low-friction member being compressible radially into said high-friction material when said touch roller presses the band against said outer periphery, to enable the band to contact said high-friction material and receive retraction forces therefrom.

3. Apparatus according to claim 2, wherein said driven roller comprises a tensioning roller, said retracting roller means further includes a driven reversing roller and an additional touch roller selectively displaceable toward said reversing roller, said reversing roller and said second touch roller disposed behind said feed rollers and in front of said tensioning roller.

4. Apparatus according to claim 2, wherein said low friction member is of circumferentially endless configuration.

5. Apparatus according to claim 2, wherein said low friction member comprises a thrust washer formed of teflon-coated stainless steel.

6. Apparatus according to claim 2, wherein said low friction member is of circumferentially interrupted configuration.

7. Apparatus according to claim 2, wherein said feed rollers comprise a driven feed roller and another touch roller selectively displaceable toward said driven feed roller.

8. Apparatus according to claim 2, wherein said low friction member is embedded in said high friction material at a location midway of the width of said outer periphery.

* * * * *